US005931391A

United States Patent [19]

Tani et al.

[11] Patent Number: 5,931,391

[45] **Date of Patent: *Aug. 3, 1999**

[54] FLUID INJECTION VALVE

[75] Inventors: Yasuhide Tani; Yukio Mori, both of Nagoya, Japan

[73] Assignee: Denso Corporation, Kariya, Japan

[ * ] Notice: This patent is subject to a terminal disclaimer.

[21] Appl. No.: 08/942,479

[22] Filed: Oct. 2, 1997

[30] Foreign Application Priority Data

| | | | |
|---|---|---|---|
| Oct. 25, 1996 | [JP] | Japan | 8-283791 |
| Jul. 3, 1997 | [JP] | Japan | 9-178161 |
| Sep. 10, 1997 | [JP] | Japan | 9-245091 |

[51] Int. Cl.[6] ..... F02M 51/06

[52] U.S. Cl. ..... 239/585.4; 239/533.12; 239/522

[58] Field of Search ..... 239/538, 585.1–585.5, 239/533.02, 552

[56] References Cited

U.S. PATENT DOCUMENTS

| | | | |
|---|---|---|---|
| 4,057,190 | 11/1977 | Kiwior et al. | 239/533.12 X |
| 4,519,370 | 5/1985 | Iwata | 239/533.12 X |
| 4,646,974 | 3/1987 | Sofianek et al. | 239/533.12 X |
| 5,016,819 | 5/1991 | Wood | 239/585.1 X |
| 5,383,607 | 1/1995 | Heyes et al. . | |
| 5,484,108 | 1/1996 | Nally | 239/585.4 X |
| 5,570,843 | 11/1996 | Heyse et al. | 239/585.4 X |
| 5,762,272 | 6/1998 | Tani et al. | 239/585.4 X |

FOREIGN PATENT DOCUMENTS

| | | | |
|---|---|---|---|
| 403264769 | 11/1991 | Japan | 239/533.12 |

*Primary Examiner*—Kevin Weldon
*Attorney, Agent, or Firm*—Nixon & Vanderhye P.C.

[57] ABSTRACT

A fluid injection valve includes a valve seat having a conical concave surface and a valve seat surface, a needle having an edge surface and an annular contact surface whose diameter is Ds, an orifice plate having a perforated surface disposed in a downstream portion at a distance h from the edge surface of the needle and at a distance H from valve seat surface. Thus, a fluid chamber is defined by the perforated surface of the orifice plate, the edge surface of the needle and the conical concave surface of the valve seat. The perforated surface has a plurality of first orifices having a diameter d on a first circle whose diameter is DH. The fluid chamber is formed to have the following relationships among the diameters Ds, DH, d and the distances h, H: 1.5<Ds/DH<6, h<1.5d, and H<4d.

25 Claims, 8 Drawing Sheets

FLUID INJECTION VALVE

CROSS REFERENCE TO RELATED APPLICATION

The present application is based on and claims priority from Japanese Patent Applications Hei 8-283791 filed on Oct. 25, 1996, Hei 9-178161 filed on Jul. 3, 1997, and Hei 9-245091 filed on Sep. 10, 1997, the contents of which are incorporated herein by reference.

BACKGROUND OF THE INVENTION

1. Field of the Invention

The present invention relates to a fluid injection valve, particularly, a fuel injection valve for an internal combustion engine.

2. Description of the Related Art

In order to reduce the fuel consumption and to control emission of the exhaust gases, atomization of the fuel is one of the most effective measures. For this purpose, there have been proposed an idea that air is blasted into the fuel and an idea that a portion of the nozzle surrounding the nozzle hole is heated.

However, if such ideas are put into practical devices, such devices would become too expensive.

U.S. Pat. No. 5,383,697 proposes an injection valve, in which a recess is provided between a perforated plate and an edge of a needle. The recess may be formed on the edge of the needle or on the perforated plate.

In the above injection valve, the fluid spreads in the axial direction when it flows into the recess and makes whirls around the recess, thereby reducing the internal energy for atomizing the fluid. Therefore, the fluid cannot be atomized effectively.

SUMMARY OF THE INVENTION

The present invention has an object of providing an improved fluid injection nozzle which can atomize the fluid effectively.

According to a main feature of the present invention, a fluid injection valve including a valve seat having a valve seat surface, a needle having an edge surface and an annular contact surface whose diameter is Ds, an orifice plate having a perforated surface disposed at a distance h from the edge surface of the needle and at a distance H from the valve seat surface, and the perforated surface has a plurality of first orifices having a diameter d on a first circle whose diameter is DH, and the diameters Ds, DH, d and the distances h, H have the following relationships: $1.5<Ds/DH<6$, $h<1.5d$, and $H<4d$.

Another feature of the fluid injection valve as stated above is that the first orifices are disposed on the first circle at equal intervals. The diameter d may be smaller than 0.3 mm, more preferably, smaller than 0.25 mm.

Another feature of the fluid injection valve as stated above is that each of the first orifices is inclined at an angle $\theta 1$ with respect to the center axis thereof to direct fluid radially outward.

Another feature of the fluid injection valve as stated above is that the perforated surface further has a plurality of second orifices having a diameter d on a second circle outside the circle, and the diameter of the second circle is within the same relationships as the diameter DH.

Another feature of the fluid injection valve as stated above is that the number of the second orifices is the same as the number of the first orifices, and each of the second orifices is inclined at an angle $\theta 2$ which is larger than the angle $\theta 1$ of the first orifice to direct fluid radially outward. The angle $\theta 1$ may be about 15°. However, the number of the second orifices may be twice as many as the number of the first orifices.

Another feature of the fluid injection valve as stated above is that the edge surface of the needle and the perforated surface of the orifice plate are disposed substantially in parallel with each other. The edge surface of the needle and the perforated surface of the orifice plate may be flat or curved. That is, the edge surface of the needle may be convex and the perforated surface of the orifice plate may be concave.

Another feature of the fluid injection valve as stated above is that the thickness t of the orifice plate and the diameter d of the orifices has the following relationship: $0.5<t/d<1$.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

First Embodiment

A fuel injection valve for a gasoline engine according to a first embodiment of the present invention is described with reference to FIGS. 1, 2 and 3.

Figure 3:
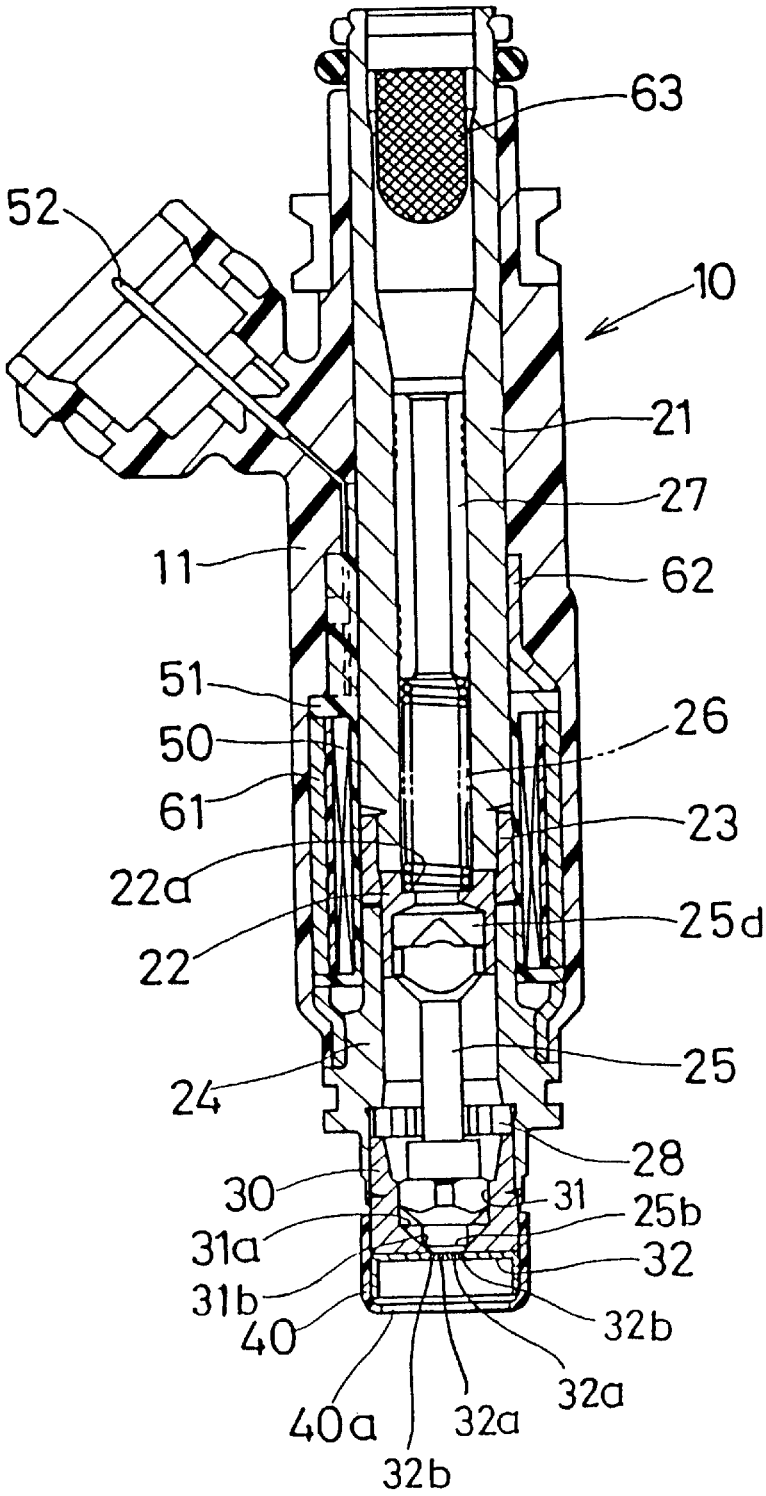
FIG. 3 is a longitudinal sectional view illustrating the fuel injection valve according to the first embodiment.

As shown in FIG. 3, a stationary core 21 made of ferromagnetic material is accommodated in a housing mold 11 which is made of synthetic resin. A cylindrical movable core 22 made of magnetic material is disposed slidably in a space defined by the bottom surface of the stationary core 21, a nonmagnetic pipe 23 and a magnetic pipe 24 in line with the stationary core 21 to face each other at a certain space. An end of the nonmagnetic pipe 23 is fitted to an outer periphery of the lower end of the stationary core 21 and welded thereto by laser welder or the like. The nonmagnetic pipe 23 has an inner surface for guiding the movable core 22 and is connected to the magnetic pipe 24 at the other end thereof. A needle 25 is fixed to the movable core 22 at a connecting portion 25*d* by a laser welder or the like. A plurality of fuel passages are formed on the outer periphery of the connecting portion 25*d*.

A valve seat 30 is inserted into the inner periphery of the magnetic pipe 24 through a spacer 28 and welded thereto by a laser welder or the like. The spacer 28 has a thickness to define an air gap between the stationary core 21 and the movable core 22. A cup-shaped orifice plate 32 made of stainless steel is welded to the bottom of the valve seat 30. As shown in FIG. 1, the needle 25 has a cone-shaped edge surface 25*a* and an annular contact surface 25*b*, which is seated on a conical seat surface 31*b* formed on the valve seat 30.

A sleeve 40 made of resinous material is press-fitted to the outer peripheries of the valve seat 30 and the orifice plate 32 to protect the orifice plate 32. The orifice plate 32 has a plurality of orifices 32*a* and 32*b* on the upper perforated surface 33 thereof, through which fuel is injected to an engine via an opening 40*a* of the sleeve 40. The movable core 22 has a spring seat 22*a* on the perforated surface 33 thereof, on which an end of a compression coil spring 26 is seated. The other end of the compression coil spring abutts the bottom end of an adjusting pipe 27. Thus, the coil spring 26 biases the movable core 22 and the needle 25 downward so that the annular contact surface 25*b* can be seated on the seat surface 31*a* of the valve seat 30. The adjusting pipe 27 is press-fitted into the inner periphery of the stationary core 21 and disposed to adjust the biasing force of the compression coil spring 26.

An electro-magnetic coil 50 is wound around a spool 51 made of resinous material, which is disposed around stationary core 21, the nonmagnetic pipe 23 and the magnetic pipe 24, and the electromagnetic coil 50 and the spool 51 are enclosed by the housing mold 11. A terminal 52 extends from the hosing mold 11 and is connected to the electromagnetic coil 50 through a lead wire.

When the electromagnetic coil 50 is energized by an electronic controller (not shown) through the terminal 52, the needle 25 and the movable core 22 is attracted toward the stationary core 21, and the annular contact surface 25*b* leaves the valve seat surface 31*b* against the biasing force of the compression coil spring 26.

A pair of magnetic plates 61 and 62 are disposed to surround an upper portion of the stationary core 21 and the magnetic pipe 24 to provide a path for the magnetic flux of the electro-magnetic coil 50. The plate also protects the electro-magnetic coil 50 from outside. A filter 63 is disposed at an upper portion of the stationary core 21 to remove foreign particles of the fuel supplied to the fuel injection valve 10.

The fuel flows from the filter 63 through the inside of the adjusting pipe 27, the fuel passage formed on the connecting portion 25*d* of the needle 25 and a fuel passage formed on the sliding surface between the valve seat 30 and the needle 25 to the valve portion composed of the annular contact surface 25*b* and the valve seat surface 31*b*.

Figure 1:
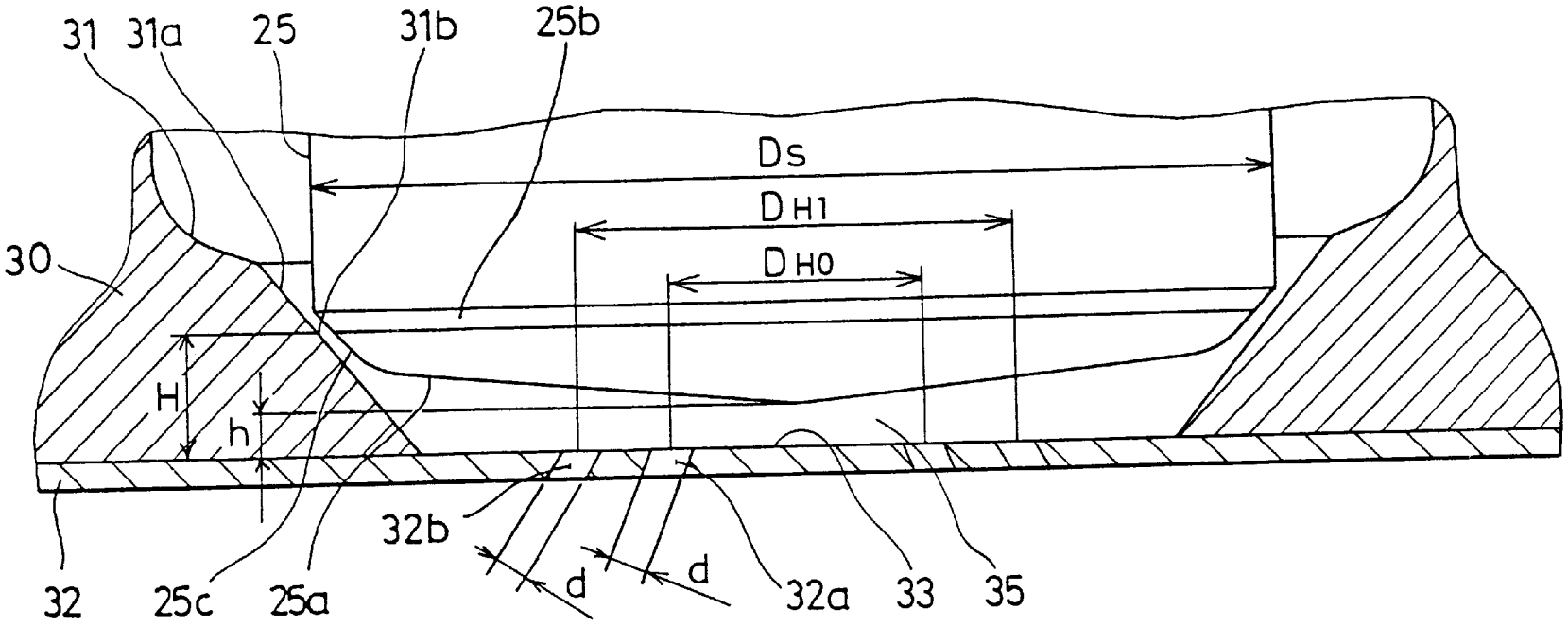
FIG. 1 a sectional view illustrating an edge portion of a nozzle of a fuel injection valve according to a first embodiment of the present invention.

When the annular contact surface 25*b* leaves the valve seat surface 31*b* as shown in FIG. 1, the fuel flows into a fuel chamber 35. The fuel chamber 35 is formed into a generally disk-like space by the perforated surface 33 of the orifice plate 32, a conical surface portion 31*a* of the valve seat and the edge surface 25*a*.

Figure 4A:
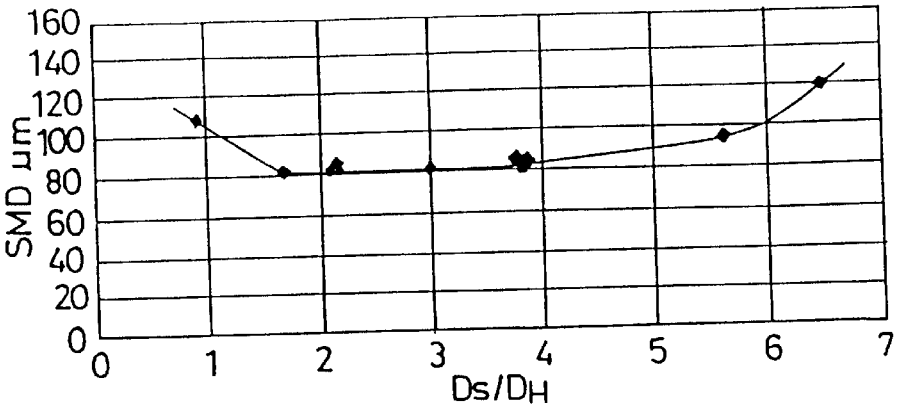
FIG. 4A is a graph showing relationship between DS/DH and SMD.

As shown in FIG. 1, the edge portion of the needle 25 is formed by the edge surface 25*a*, the annular contact surface 25*b* and a corner-ring portion 25*c* between the edge surface 25*a* and the annular contact surface 25*b*. The edge surface 25*a* is formed radially inside the contact surface 25*b*, and the center thereof is located on the axis of the needle. An axial distance h is formed between the center of the edge surface 25*a* and the perforated surface 33 of the orifice plate 32 when the needle 25 is lifted. Each of the orifices 32*a* and 32*b* has a diameter d (e.g. 0.15 mm), and the relationship between the diameter d and the axial distance h is decided by test results related to the atomization of the fuel. The effect of the atomization can be represented by SMD (Sauter Mean Diameter), and FIGS. 4A–4C are graphs showing relationship between the SMD and sizes of various portions of the fuel injection valve shown in FIG. 1.

Figure 4B:
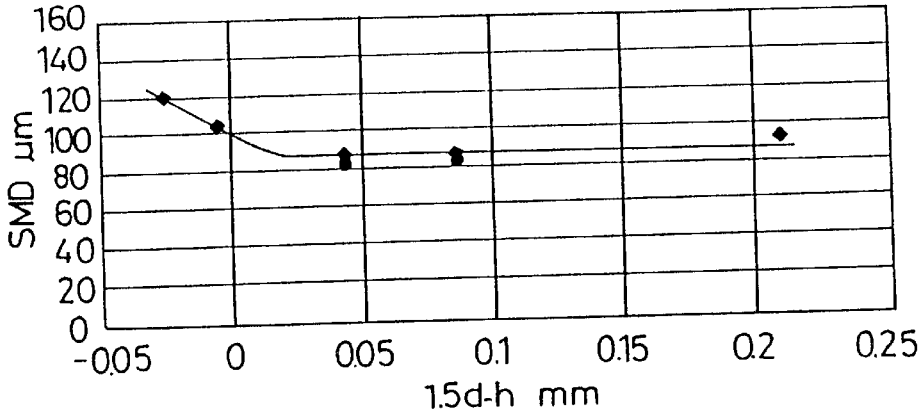
FIG. 4B is a graph showing relationship between 1.5d−h and SMD
Figure 4C:
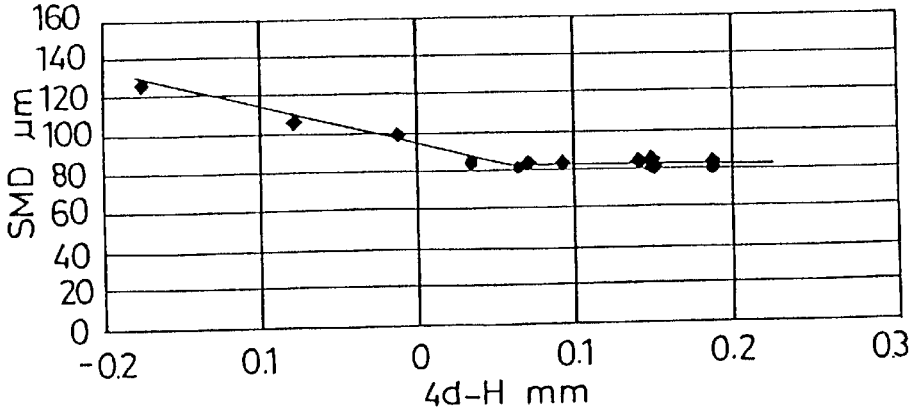
FIG. 4C is a graph showing relationship between 4d−H and SMD.

FIG. 4B shows that SMD becomes less than 100 $\mu$m and the fuel atomization can be obtained effectively if:

$$1.5d-h>0, \text{ where } d<0.3 \text{ mm} \quad (1)$$

It has been found that the diameter d smaller than 0.25 mm such as 0.15 mm with as many orifices as possible can increase the surfaces of the fuel in contact with air, thereby increasing the atomization.

The inside diameter of the conical surface 31*a* of the valve seat 30 decreases as the surface approaches the perforated surface 33 of the orifice plate 32.

FIG. 4C shows that a distance H of the valve seat surface 31*b* from the perforated surface 33 is shorter than 4*d*, which is expressed as follows:

$$4d-H>0 \quad (2)$$

Figure 2A:
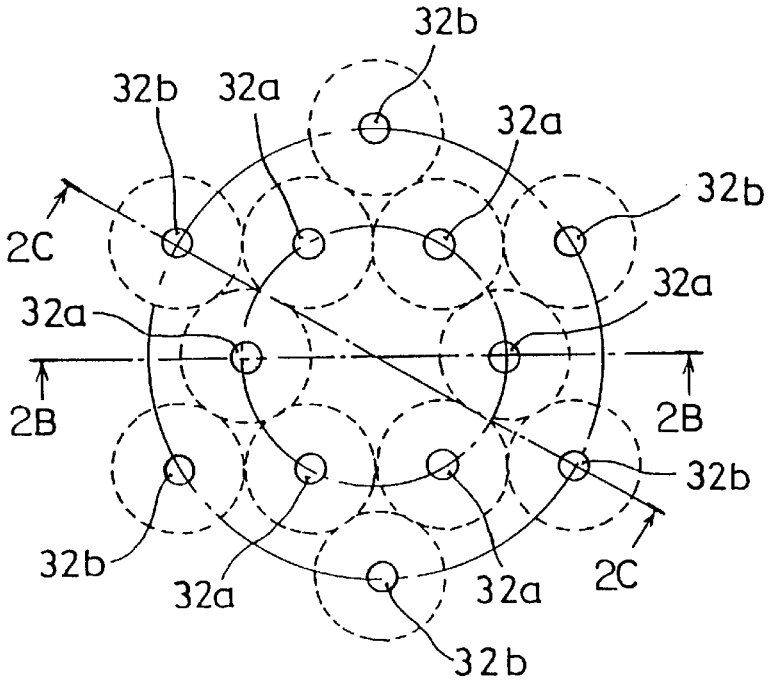
FIG. 2A is a schematic view illustrating disposition of a plurality of orifices of an orifice plate of the fuel injection valve according to the first embodiment.
Figure 2B:
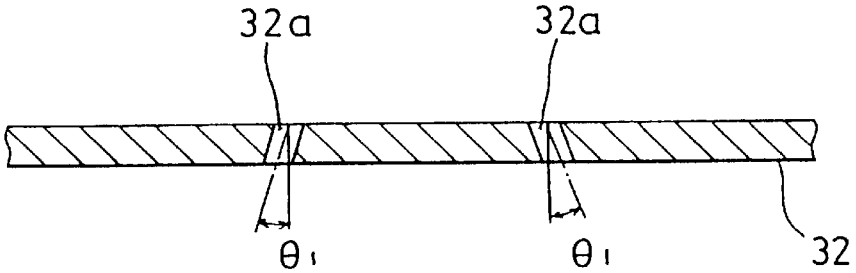
FIG. 2B is a sectional view of the orifice plate shown in FIG. 2A cut along a line B—B.

The orifice plate 32 has twelve orifices 32*a* and 32*b* formed on the area of the perforated surface defining the fuel chamber 35 as shown in FIG. 2A. Six inner orifices 32*a* are disposed on an imaginary inner circle, whose diameter is DH0 as shown in FIG. 1, at equal intervals, and six outer orifices 32*b* are disposed on an imaginary outer circle, whose diameter is DH1 as shown in FIG. 1, at equal intervals so that each concentric circle of the inner and outer orifices 32*a*, 32*b* having the same diameter is disposed to be in contact with the concentric circles of the adjacent orifices. The number of inner orifices 32*a* and the number of the outer orifices are the same and the orifices 32*a* and 32*b* are disposed to be symmetrical with respect to a line across orifices disposed opposite sides of the perforated surface 33 of the orifice plate 32. Thus, the fuel can be injected evenly.

FIG. 1 shows that the diameter Ds of the needle at the portion in contact with the valve seat, the diameter DH0 of the imaginal inner circle of the inner orifices 32*a* and the diameter DH1 of the imaginal outer circle of the outer orifices has the following relationship:

$$1.5<Ds/DH0<6$$

$$1.5<DS/DH1<6 \quad (3)$$

Each of the inner and outer orifices 32*a* and 32*b* is inclined to direct the fuel injection outward as shown in FIG.

Figure 2C:
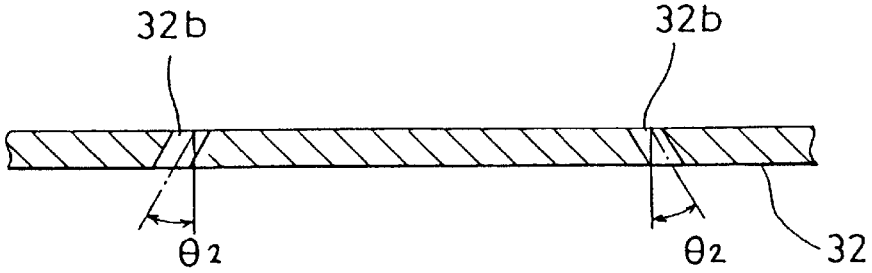
FIG. 2C is a sectional view of the orifice plate shown in FIG. 2A cut along a line C—C.

2B and FIG. 2C. The inclination angle θ1 of the inner orifices 32*a* and the inclination angle θ2 of the outer orifices has the following relationship:

$$\theta 1 < \theta 2 \quad (4)$$

Since the inclination angle of the outer orifices is larger, the fuel injected from the inner orifices and the fuel injected from the outer orifices do not intersect with each other, and the fuel can be atomized effectively.

When the electromagnetic coil 50 is energized and the needle 25 is lifted to leave the conical surface 31*a* of the valve seat 30, the fuel flows through the space between the annular contact surface 25*b* and the valve seat surface 31*b* to the orifice plate 32, where the fuel impinges on the perforated surface 33 and turns toward the fuel chamber 35, thereby forming a fuel flow along the perforated surface 33. The fuel flow branches out into one set of flows directly going to the orifices 32*a* and 32*b* and another set of flows passing along portions of the perforated surface 33 between the orifices 32*a* and 32*b* toward the center of the perforated surface 33, where the latter flows impinge upon one another so that the fuel is atomized effectively and returned to the orifices to be injected.

Figure 5:
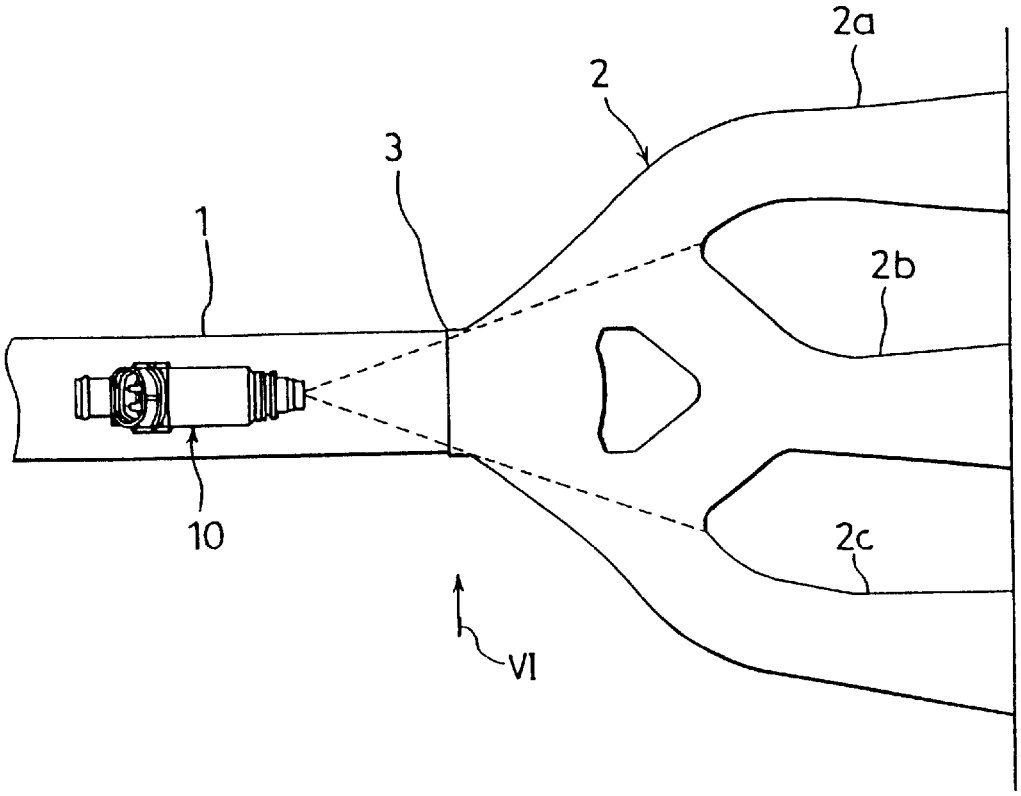
FIG. 5 is a schematic view illustrating the fuel injection valve according to the first embodiment installed in an intake manifold.
Figure 6:
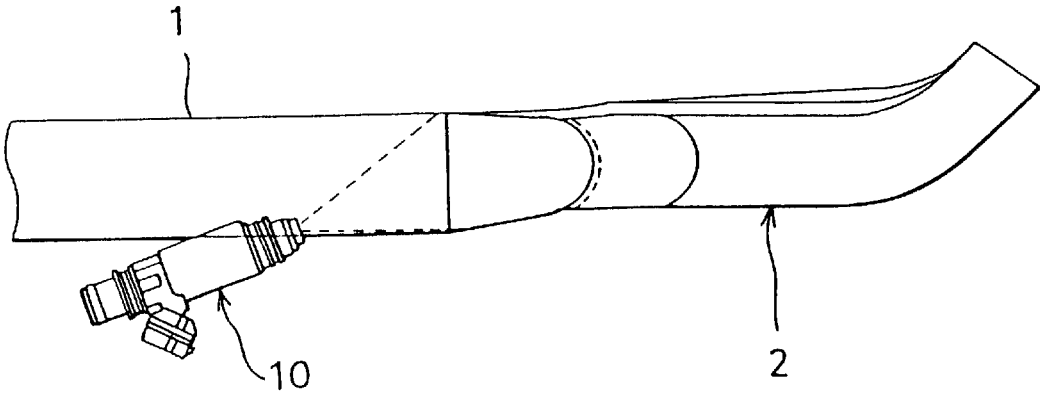
FIG. 6 is a schematic side view of the injection valve shown in FIG. 5 viewed from an arrow VI.

The fuel injection valve 10 is installed in the engine intake pipe at a portion between the throttle valve (not shown) and the intake manifolds 2*a*, 2*b* and 2*c* as shown in FIGS. 5 and 6. The intake pipe shown here is one for a three-cylinder engine. The fuel injection valve 10 injects the fuel as indicated by broken lines.

Figure 7:
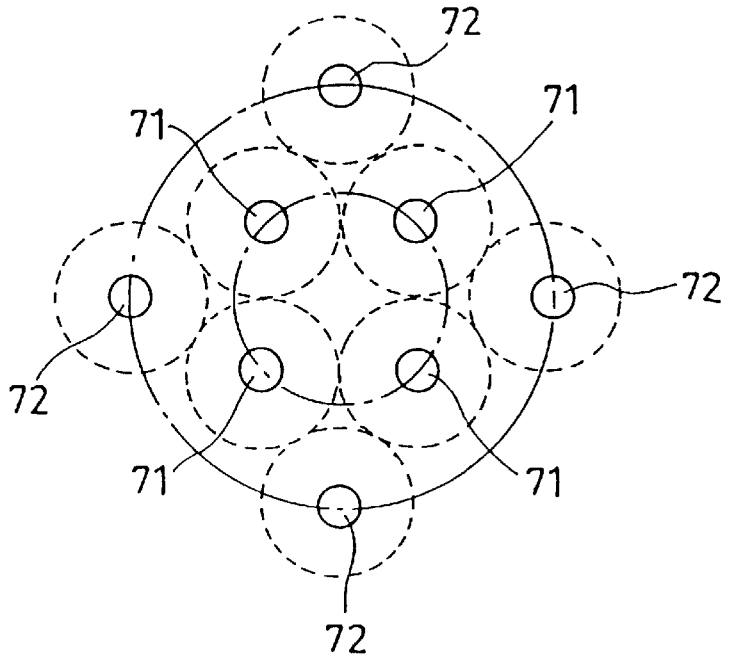
FIG. 7 is a schematic view illustrating disposition of a plurality of orifices of a modified orifice plate of the fuel injection valve according to the first embodiment.
Figure 8:
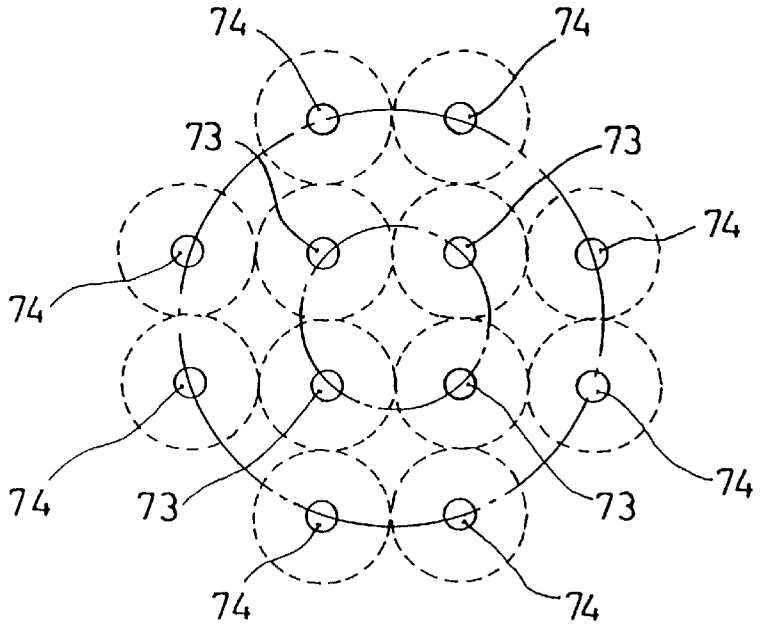
FIG. 8 is a schematic view illustrating disposition of a plurality of orifices of a modified orifice plate of the fuel injection valve according to the first embodiment.
Figure 9:
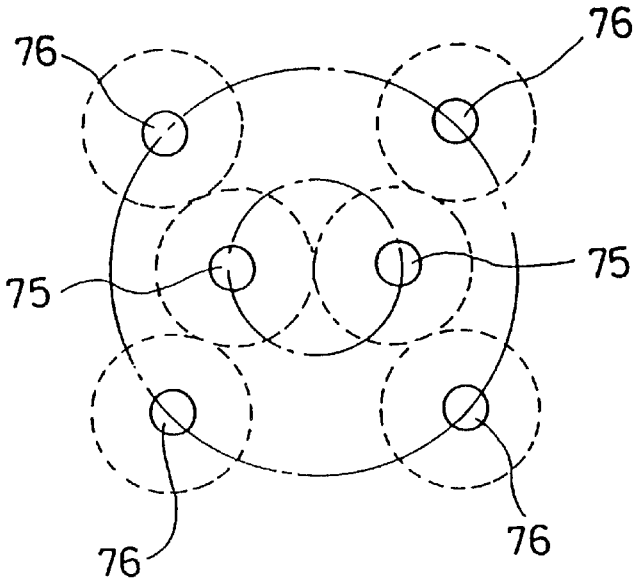
FIG. 9 is a schematic view illustrating disposition of a plurality of orifices of a modified orifice plate of the fuel injection valve according to the first embodiment.

A variation of the orifice plate shown in FIG. 7 has four inner orifices 71 and four outer orifices 72, and another variation shown in FIG. 8 has four inner orifices 73 and eight outer orifices 74. Another variation shown in FIG. 9 has two inner orifices 75 and four outer orifices 76. The diameter of the orifices increases as the number thereof decreases while the above stated relationships (1), (2) and (3) are maintained.

Second Embodiment

Figure 10:
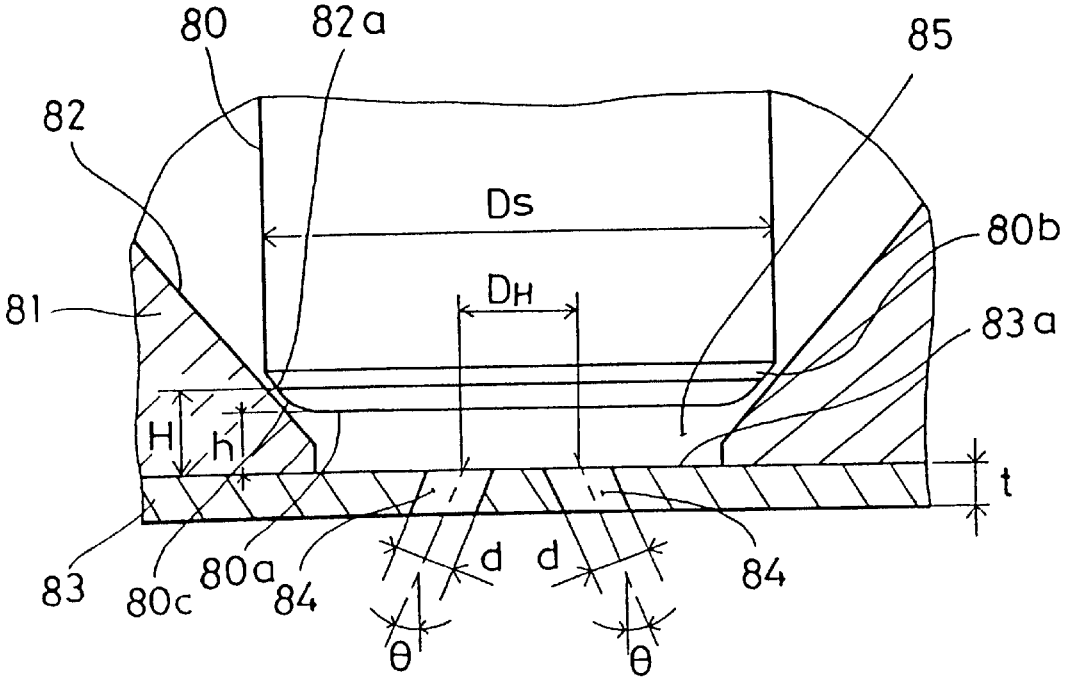
FIG. 10 is a sectional view illustrating a portion of a nozzle of a fuel injection valve according to a second embodiment of the present invention.

A fuel injection valve 10 according to a second embodiment of the present invention is described with reference to FIG. 10. The edge portion of a needle 80 has an edge surface 80*a*, an annular contact surface 80*b* and a corner ring surface 80*c*. The annular contact surface 80*b* can be seated on a valve seat surface 82*a* of a conical surface 82 of a valve seat 81.

The edge surface 80*a* has a generally flat surface which is in parallel with an perforated surface 83*c* of an orifice plate 83. The orifice plate 83 has four orifices 84. In this embodiment, the same relationships as the first embodiment exist between the axial distance h (between the edge surface and the perforated surface), the distance H of the valve seat surface from the perforated surface, and the diameter d of the orifices 84, and between the diameter of the needle Ds and the diameter of the circle DH. The inclination angle θ of the orifices is not smaller than 15 degree in angle, preferably larger than 20 degree.

Third Embodiment

Figure 11:
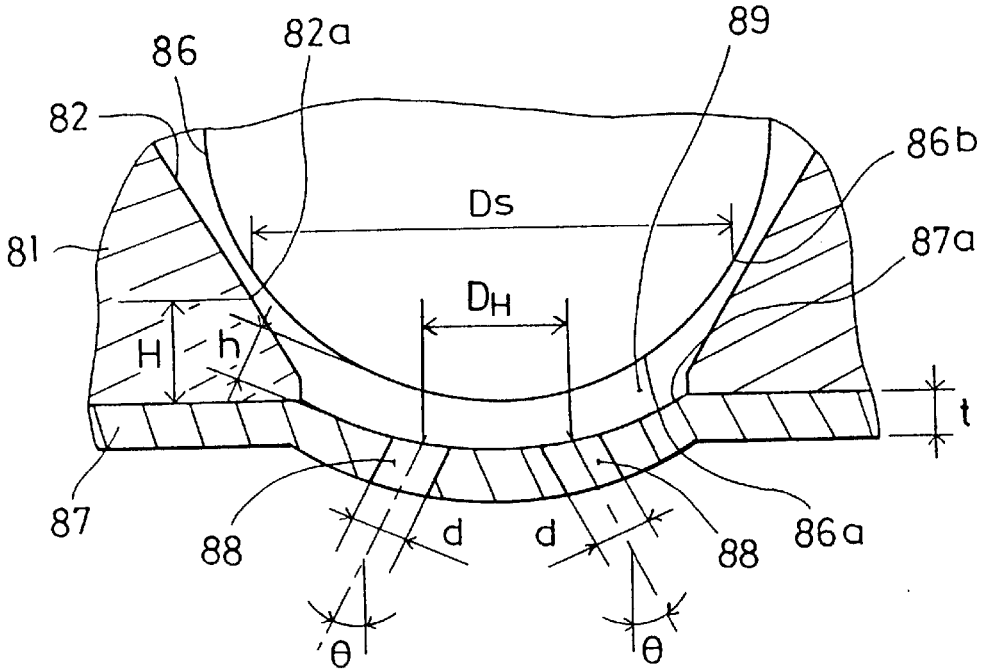
FIG. 11 is a sectional view illustrating a portion of a nozzle of a fuel injection valve according to a third embodiment of the present invention.

A fuel injection valve according to a third embodiment of the present invention is described with reference to FIG. 11. The edge portion of a needle 86 has a spherical edge surface 86*a* and a contact surface 86*b* which is a part of the spherical surface 86*a*. The contact surface 86*b* can be seated on the valve seat surface 82*a* of a conical surface 82 of a valve seat 81. An orifice plate 87 has a spherical concave perforated surface 87*a* whose center is the same as the center of the spherical edge surface 86*a*, so that the perforated surface 87*a* of the orifice plate 87 is disposed in parallel with the edge surface 86*a* at an interval (axial distance) h which is discussed before. The perforated surface 87*a* has four orifices 88 having the diameter d which is discussed before. In this embodiment, the same relationships as the first and embodiments exist between the interval h, the distance H of the seat surface from the perforated surface 87*a*, and the diameter d, and between the diameter of the needle Ds and the diameter of the circle DH (same as DH0). The inclination angle θ of the orifices 88 is not smaller than 15 degrees in angle, preferably larger than 20 degree.

When the needle is lifted from the valve seat surface 82*a*, fuel flows through space between annular contact surface 86*b* and the valve seat surface 82*a* to the perforated surface 87*a*, where the fuel turns toward the fuel chamber 89, thereby forming fuel flows along the perforated surface 87*a*. The fuel flow branches out into one that flows directly going to the orifices 88 and another that flows passing along portions of the perforated surface 87*a* between the orifices 88 toward the center of the perforated surface 87*a*, where the latter flows impinge upon one another so that the fuels are atomized effectively and returned to the orifices to be injected.

Fourth Embodiment

Figure 12:
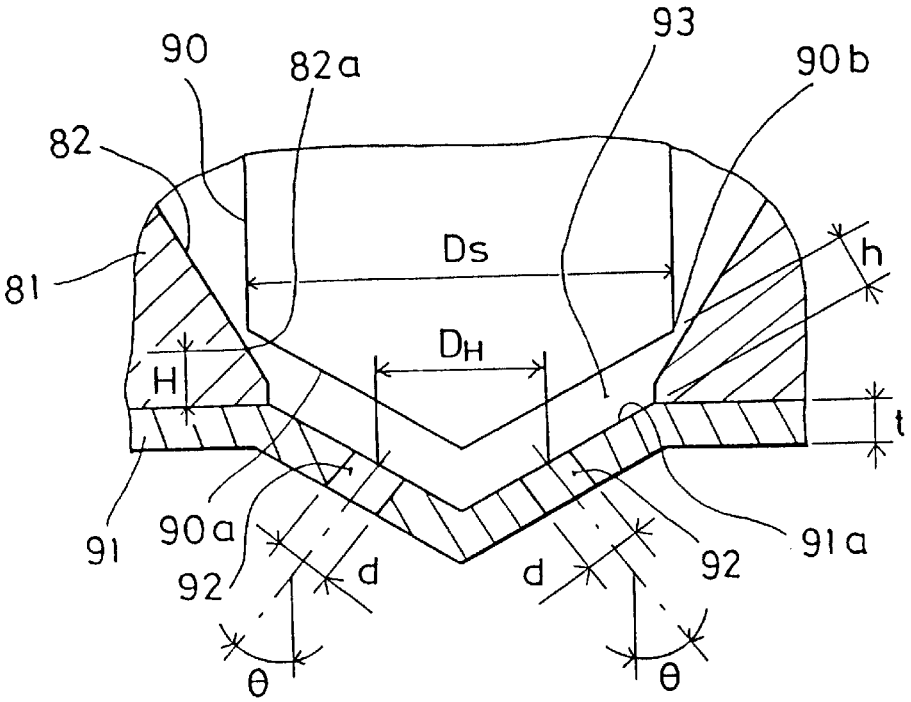
FIG. 12 is a sectional view illustrating a portion of a nozzle of a fuel injection valve according to a fourth embodiment of the present invention.

A fuel injection valve according to a fourth embodiment is described with reference to FIG. 12.

The edge portion of a needle 90 has a conical convex edge surface 90*a* and a contact surface 90*b*. The contact surface 90*b* can be seated on the valve seat surface 82*a*. An orifice plate 91 has a conical concave perforated surface 91*a* whose center axis is the same as the center axis of the edge surface 90, so that the perforated surface 87*a* of the orifice plate 91 is disposed in parallel with the edge surface 90*a* at an interval (axial distance) h which is discussed before. The perforated surface 91*a* has four orifices 92 having the diameter d which is discussed before.

In this embodiment, the same relationships as the first embodiment exist between the interval h, the distance H of the seat surface from the perforated surface 91*a*, and the diameter d, and between the diameter of the needle Ds and the diameter of the circle DH (same as DH0). The inclination angle θ of the orifices 92 is not smaller than 15 degrees in angle.

When the needle is lifted from the valve seat surface 91*a*, the fuel flows through the space between the annular contact surface 90*b* and the valve seat surface 82*a* to the perforated surface 91*a*, where the fuel turns toward the fuel chamber 93, thereby forming a fuel flow along the perforated surface 91*a*. The fuel flow branches out into one that flows directly going to the orifices 92 and another that flows passing along portions of the perforated surface 91*a* between the orifices 92 toward the center of the perforated surface 91*a*, where the latter flows impinge upon one another so that the fuel is atomized effectively and returned to the orifices to be injected.

The number of orifices can be increased to any number more than 2.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. A fluid injection valve including a valve seat having a conical concave surface and a valve seat surface, a needle having an edge surface and an annular contact surface whose diameter is Ds, an orifice plate having a perforated surface disposed in a downstream portion at a distance h from said edge surface of said needle and at a distance H from valve seat surface, thereby forming a fluid chamber with said perforated surface of said orifice plate, said edge surface of said needle and said conical concave surface of said valve seat, wherein:

said perforated surface has a plurality of first orifices having a diameter d on a first circle whose diameter is DH, and said annular contact surface and said valve seat surface are inclined to said perforated surface to cause fluid to impinge on said perforated surface thereby forming a fuel flow alone said perforated surface to said first orifices;

said diameters Ds, DH, d and said distances h, H have the following relationships:

$$1.5<Ds/DH<6,$$

$$h<1.5d, \text{ and}$$

$$H<4d.$$

2. A fluid injection valve as in claim 1, wherein:

said first orifices are disposed on said first circle at equal intervals.

3. A fluid injection valve as in claim 1, wherein:

each of said first orifices is inclined at an angle θ1 with respect to the center axis thereof to direct fluid radially outward.

4. A fluid injection valve including a valve seat having a conical concave surface and a valve seat surface, a needle having an edge surface and an annular contact surface whose diameter is Ds, an orifice plate having a perforated surface disposed in a downstream portion at a distance h from said edge surface of said needle and at a distance H from valve seat surface, thereby forming a fluid chamber with said perforated surface of said orifice plate, said edge surface of said needle and said conical concave surface of said valve seat, wherein:

said perforated surface has a plurality of first orifices having a diameter d on a first circle whose diameter is DH, said diameters Ds, DH, d and said distances h, H have the following relationships:

$$1.5<Ds/DH<6,$$

$$h<1.5d, \text{and}$$

$$H<4d;$$

said perforated surface further has a plurality of second orifices having a diameter d on a second circle outside said circle, and the diameter of said second circle is within the same relationships as said diameter DH.

5. A fluid injection valve as in claim 4, wherein:

the number of said second orifices is the same as the number of said first orifices.

6. A fluid injection valve as in claim 5, wherein:

each of said second orifices is inclined at an angle θ2 which is larger than said angle θ1 of said first orifice to direct fluid radially outward.

7. A fluid injection valve as in claim 4, wherein:

the number of said second orifices is twice as many as the number of said first orifices.

8. A fluid injection valve as in claim 7, wherein:

each of said second orifices is inclined at an angle θ2 which is larger than said angle θ1 of said first orifice to direct fluid radially outward.

9. A fluid injection valve as in claim 1, wherein:

said edge surface of said needle and said perforated surface of said orifice plate are disposed substantially in parallel with each other.

10. A fluid injection valve as in claim 9, wherein:

each of said first orifices is inclined at an angle with respect to the center axis thereof to direct fluid radially outward.

11. A fluid injection valve as in claim 1, wherein:

said orifice plate has a thickness t, and said thickness t and said diameter d of said orifices have the following relationship:

$$0.5<t/d<1.$$

12. A fluid injection valve as in claim 11, wherein:

each of said first orifices is inclined at an angle with respect to the center axis thereof to direct fluid radially outward.

13. A fluid injection valve as in claim 3, wherein said angle θ1 is about 15°.

14. A fluid injection valve as in claim 12, wherein:

said edge surface of said needle and said perforated surface of said orifice plate are disposed substantially in parallel with each other.

15. A fluid injection valve as in claim 14, wherein:

said angle θ1 is about 15°.

16. A fluid injection valve as in claim 13, wherein:

said edge surface of said needle and said perforated surface of said orifice plate are disposed substantially in parallel with each other.

17. A fluid injection valve as in claim 16, wherein:

said edge surface of said needle and said perforated surface of said orifice plate are flat.

18. A fluid injection valve including a valve seat having a conical concave surface and a valve seat surface, a needle having an edge surface and an annular contact surface whose diameter is Ds, an orifice plate having a perforated surface disposed in a downstream portion at a distance h from said edge surface of said needle and at a distance H from valve seat surface, thereby forming a fluid chamber with said perforated surface of said orifice plate, said edge surface of said needle and said conical concave surface of said valve seat, wherein:

said perforated surface has a plurality of first orifices having a diameter d on a first circle whose diameter is DH, said diameters Ds, DH, d and said distances h, H have the following relationships:

$$1.5<Ds/DH<6,$$

$$h<1.5d, \text{and}$$

$$H<4d;$$

each of said first orifices is inclined at an angle θ1 of about 15° with respect to the center axis thereof to direct fluid radially outward;

said edge surface of said needle and said perforated surface of said orifice plate are disposed substantially in parallel with each other; and said edge surface of said needle is convex and said perforated surface of said orifice plate is concave.

19. A fluid injection valve as in claim 1, wherein:

said diameter d is smaller than 0.3 mm.

20. A fluid injection valve as in claim 1, wherein:

said diameter d is smaller than 0.25 mm.

21. A fluid injection valve comprising:

a reciprocatable valve member which seats in one position on an annular contact surface of diameter Ds;

a perforated orifice plate disposed downstream at a distance H from the annular contact surface and at a distance h from the valve member when it is in an open position;

said perforated orifice plate having a plurality of orifices therethrough with a diameter d disposed on a circular locus of diameter DH;

said contact surface being disposed on a valve seat surface which is inclined inwardly downstream thereof but along a path which, if fully extended, intersects said orifice plate outside said plurality of orifices so as to influence fluid flows along the orifice plate inwardly toward the orifices; and wherein said dimensions Ds, DH, d, h and H have the following relationships:

$$1.5<Ds/DH<6,$$

$$h<1.5d, and$$

$$H<4d.$$

22. A fluid injection valve as in claim 21 wherein said orifices have respective axes that are inclined outwardly with respect to a center axis of the valve so as to direct fuel flows therethrough radially outward.

23. A fluid injection valve as in claim 21 wherein:

said perforated plate has a further plurality of orifices having a diameter d disposed on a further circular locus of diameter DH' outside that of the earlier-recited orifices but where the further circular locus of diameter DH' still satisfies the relationship 1.5<Ds/DH'<6 and is still disposed inwardly of the intersection of the orifice plate with the extended downstream valve seat surface.

24. A fluid injection valve as in claim 23 wherein all the orifices have respective axes that are inclined outwardly with respect to a center axis of the valve so as to direct fuel flows therethrough radially outward.

25. A fluid injection valve as in claim 24 wherein the angle of inclination for said further orifices is greater than that for the earlier-recited orifices.

* * * * *